US008627782B2

(12) United States Patent
Fujihara et al.

(10) Patent No.: US 8,627,782 B2
(45) Date of Patent: Jan. 14, 2014

(54) METHOD FOR COATING WITH COATING LIQUID, COATING APPARATUSES FOR USE THEREIN, AND METHOD FOR DESIGNING THE SAME

(75) Inventors: Makoto Fujihara, Ibaraki (JP); Junya Tabuchi, Ibaraki (JP); Makoto Komatsubara, Ibaraki (JP)

(73) Assignee: Nitto Denko Corporation, Ibaraki-shi, Osaka (JP)

( * ) Notice: Subject to any disclaimer, the term of this patent is extended or adjusted under 35 U.S.C. 154(b) by 15 days.

(21) Appl. No.: 13/453,449

(22) Filed: Apr. 23, 2012

(65) Prior Publication Data

US 2012/0204789 A1 Aug. 16, 2012

Related U.S. Application Data

(62) Division of application No. 11/689,726, filed on Mar. 22, 2007, now Pat. No. 8,187,674.

(30) Foreign Application Priority Data

Mar. 24, 2006 (JP) ..... 2006-083153

(51) Int. Cl.
*B05C 3/02* (2006.01)
*B05D 3/12* (2006.01)
*B05D 1/30* (2006.01)

(52) U.S. Cl.
USPC ..... 118/410; 427/356; 427/358; 427/420

(58) Field of Classification Search
USPC ..... 427/356, 420, 358; 118/410; 425/133.5, 425/376.1, 381, 466; 264/40.7, 177.1, 264/177.16
See application file for complete search history.

(56) References Cited

U.S. PATENT DOCUMENTS

| | | | |
|---|---|---|---|
| 5,500,274 | A | 3/1996 | Francis et al. |
| 5,582,645 | A | 12/1996 | Trest et al. |
| 7,105,203 | B1 | 9/2006 | Masuda et al. |

FOREIGN PATENT DOCUMENTS

| | | | |
|---|---|---|---|
| JP | 5-50004 | A | 3/1993 |
| JP | 2000-033310 | A | 2/2000 |
| JP | 2000033310 | A * | 2/2000 |

OTHER PUBLICATIONS

Japanese Office Action dated Nov. 24, 2010, issued in corresponding Japanese Patent Application No. 2006-083153.
Schuerman et al., "Chemistry of Paint", Products of Chemistry, vol. 66, vol. 4, Apr. 1989, pp. 327-328.
Taiwanese Office Action dated Mar. 8, 2012, issued in corresponding application No. 096108403, with English Translation.

* cited by examiner

*Primary Examiner* — Michael Cleveland
*Assistant Examiner* — Tabatha Penny
(74) *Attorney, Agent, or Firm* — Westerman, Hattori, Daniels & Adrian, LLP

(57) ABSTRACT

A method for coating with a coating liquid according to the present invention is a method for coating an object-to-be-coated with a coating liquid containing dispersed particles, using a die, wherein the flowage of the coating liquid within a manifold 5 provided within the die is such that the deviation of the average flow rate of the coating liquid in the direction of the width becomes equal to or less than 60% of an average flow rate over the entire area of the manifold 5, in at least 80% of the area from a liquid supplying portion 8 in the manifold to an end portion P of the manifold.

4 Claims, 8 Drawing Sheets

FLOW-RATE DISTRIBUTION WITHIN MANIFOLD IN COMPARISON EXAMPLES 1 AND 2

METHOD FOR COATING WITH COATING LIQUID, COATING APPARATUSES FOR USE THEREIN, AND METHOD FOR DESIGNING THE SAME

CROSS-REFERENCE TO RELATED APPLICATIONS

This is a divisional application of U.S. patent application Ser. No. 11/689,726, filed on Mar. 22, 2007, now U.S. Pat. No. 8,187,674, which claims the benefit of Priority from Japanese Patent Application No. 2006-83153, filed on Mar. 24, 2006, the entire contents of which are incorporated herein by reference.

BACKGROUND OF THE INVENTION

1. Field of the Invention

The present invention relates to a method for coating with a coating liquid using a die, a coating apparatus for use therein and a method for designing the same and, more particularly, relates to a method for uniformly coating without inducing coating stripes, a coating apparatus for use therein and a method for designing the same.

2. Description of Related Art

Conventionally, designing of the insides of slot dies has been conducted in such a way as to uniformize the amount of a coating liquid ejected from a die ejecting portion in the direction of the width, in order to suppress the variation of the coating thickness in the direction of the width for improving the uniformity of the coating thickness. A slot die is provided with a slot (manifold) for transferring a coating liquid to the inside of the die in the direction of the width and a slit-shaped flow channel for offering the effect of rectifying the coating liquid between the manifold and the die ejecting portion. Accordingly, the shape of the manifold, particularly the cross-sectional shape thereof in the direction of flow of the coating liquid, is designed, in such a way as to uniformize the pressure loss caused between the manifold and the ejecting portion in the direction of the width or in such a way as to uniformize the cross-sectional area of the manifold in the direction of flow of the coating liquid, in order to uniformize the amount of the coating liquid ejected in the direction of the width (refer to Japanese Unexamined Patent Publication No. 5-50004).

However, with a slot die produced according to the design, the flow rate of the coating liquid is decreased within the manifold as the coating liquid flows away from a liquid supplying portion which supplies the coating liquid to the manifold, which increases, at an accelerated pace, the time period during which the coating liquid flows within the die as the coating liquid approaches the coating end. This induces the problem of degradation of the external appearance of the coating film, such as the occurrence of stripes, in cases of using a time-varying coating liquid, such as slurry containing dispersed particles, with the slot die produced according to the design.

SUMMARY OF THE INVENTION

The present invention was made in view of the problems and aims at providing a method for coating with a coating liquid, an apparatus for use therein and a method for designing the coating apparatus which enable coating an object-to-be-coated with a time-varying coating liquid using a die while alleviating the degradation of the external appearance of the coating film such as the occurrence of specific stripes therein.

The present inventors have earnestly studied methods for coating with a coating liquid, coating apparatuses for use therein and methods for designing coating apparatuses, in order to overcome the conventional problems. Consequently, they have found that there is a correlation between the time period during which the coating liquid flows within a die, more specifically within a manifold, and the area of the applied coating liquid in which stripes are generated. Thus, they have completed the present invention.

Namely, in order to overcome the problems, a method for coating with a coating liquid according to the present invention is a method for coating an object-to-be-coated with a coating liquid containing dispersed particles, using a die, wherein a flowage of the coating liquid within a manifold provided within the die is such that deviation of an average flow rate of the coating liquid in a direction of width becomes equal to or less than 60% of an average flow rate over an entire area of the manifold, in at least 80% of an area from a liquid supplying portion in the manifold to an end of the manifold.

If the coating liquid stays for a long time within the manifold in some areas, this will cause, after applying a coating liquid to an object-to-be-coated, thin, narrow and long stripes at the portions of the coating film which correspond to the area. However, by producing flowage of the coating liquid within the manifold such that the deviation of the average flow rate of the coating liquid in the direction of the width becomes equal to or less than 60% of an average flow rate over the entire area of the manifold, in at least 80% of the area from the liquid supplying portion to the end portion, as described above, it is possible to reduce the area of the manifold in which the coating liquid stays to reduce the variation of the coating-liquid flowing time period in the direction of the width of the manifold as much as possible, thereby reducing the bias thereof. This can suppress the occurrence of stripes in the coating film formed from the coating liquid applied to the object-to-be-coated, thereby causing the coating film to have a preferable external appearance.

Preferably, the flowage of the coating liquid within the manifold is such that the average flow rate of the coating liquid is increased with increasing distance from the liquid supplying portion, in at least 40% of the area from the liquid supplying portion in the manifold to the end portion of the manifold.

Further, an apparatus for coating with a coating liquid according to the present invention is an apparatus for coating an object-to-be-coated with a coating liquid containing dispersed particles, using a die, wherein the die includes: a die main body constituted by a pair of die plates; a manifold formed within the die main body for distributing the coating liquid in a direction of width; a liquid supplying portion provided in at least any one of the pair of die plates for supplying the coating liquid to the manifold; a slot formed between the pair of die plates so as to extend from the manifold to a front edge of the die main body; and a die lip provided at the front edge of the die main body as a coating-liquid ejecting port, and the manifold is provided within the die main body, either in parallel to the direction of the width of the die or to be inclined toward the slot by an angle not more than 5 degrees about the liquid supplying portion, and the manifold is shaped such that the following equation is satisfied, assuming that a cross-sectional area of the manifold in a direction of a longitudinal cross-sectional area is A, and a distance from a predetermined position near the liquid supplying portion to an end portion of the manifold is x, $$\frac{\partial^2 A}{\partial x^2} \geq 0$$

With the aforementioned constitution, it is possible to form the manifold to have a shape capable of satisfying the equation, which can cause the coating liquid to flow within the manifold for a time period less than a time period during which dispersed particles can be prevented from staying within the manifold as much as possible. This can provide a coating apparatus capable of coating with a coating liquid containing dispersed particles while preventing the occurrence of stripes. Such stripes are possibly caused by residence of dispersed particles within the manifold. Further, since the manifold is provided within the die such that it is parallel to the direction of the die width or is inclined toward the slot by an angle of 5 degrees or less about the liquid supplying portion, it is possible to prevent the increase of the variation of the thickness of the film formed from the applied coating liquid in the direction of the die width.

In the apparatus for coating with a coating liquid, preferably, the manifold is shaped such that deviation of an average flow rate of the coating liquid in a direction of width becomes equal to or less than 60% of an average flow rate over an entire area of the manifold, in at least 80% of an area from a liquid supplying portion in the manifold to an end of the manifold.

With the aforementioned configuration, it is possible to cause the coating liquid to flow within at least 80% of the manifold for a time period less than the time period during which dispersed particles can be prevented from staying within the manifold and from inducing stripes as much as possible. This enables provision of a coating apparatus capable of suppressing the occurrence of stripes in the coating film formed from the coating liquid applied to the to-be-coated film.

Preferably, the manifold is shaped such that the average flow rate of the coating liquid is increased with increasing distance from the liquid supplying portion, in at least 40% of the area from the liquid supplying portion in the manifold to the end portion of the manifold.

Preferably, the liquid supplying portion is provided near at least one of the end portions of the die in the direction of the width of the die. Further, a method for designing a coating apparatus according to the present invention is a method for designing a coating apparatus having a die for ejecting, from a slot, a coating liquid containing dispersed particles toward an object-to-be-coated and coating the object-to-be-coated with the coating liquid, wherein a shape of the inside of the die is determined and the die is designed by repeatedly conducting three-dimensional flowage calculations for the inside of the die, using a calculator, on the basis of input data including at least data of the material of the coating liquid, data of the coating condition and data of the shape of the inside of the die, while changing the data of the shape of the inside of the die, until the cross-sectional area A of a manifold provided within the die in the direction of the longitudinal cross-sectional area and the distance x from a predetermined position near a liquid supplying portion for supplying the coating liquid to the manifold to an end portion of the manifold satisfy the following equation, $$\frac{\partial^2 A}{\partial x^2} \geq 0$$

According to the designing method, the die is designed by repeatedly conducting three-dimensional flowage calculations for the inside of the die, on the basis of input data including at least data of the material of a coating liquid containing dispersed particles, data of the coating condition and data of the shape of the inside of the die to be designed, while changing the data of the shape of the inside of the die, until the cross-sectional area A of a manifold provided within the die in the direction of the longitudinal cross-sectional area and the distance x from a predetermined position near the liquid supplying portion to the manifold satisfy the equation. This enables designing a die capable of causing the coating liquid to flow within the manifold for a time period less than the time period during which dispersed particles can be prevented from staying within the manifold as much as possible. This enables designing a die capable of coating with a coating liquid containing dispersed particles while preventing the occurrence of stripes. Such stripes are considered to be caused by residence of dispersed particles within the manifold.

Preferably, the shape of the inside of the die is designed such that deviation of an average flow rate of the coating liquid in a direction of width becomes equal to or less than 60% of an average flow rate over an entire area of the manifold, in at least 80% of an area from a liquid supplying portion in the manifold to an end of the manifold.

With the aforementioned method, it is possible to design a die capable of causing the coating liquid to flow within at least 80% of the manifold for a time period less than the time period during which dispersed particles can be prevented from staying within the manifold and from inducing stripes as much as possible. This enables designing a coating apparatus capable of suppressing the occurrence of stripes in the coating film formed from the coating liquid applied to the to-be-coated film.

Preferably, the shape of the inside of the die is designed such that the average flow rate of the coating liquid is increased with increasing distance from the liquid supplying portion, in at least 40% of the area from the liquid supplying portion in the manifold to the end portion of the manifold.

According to the present invention, there are provided effects as follows, with the means.

Namely, with the method for coating with a coating liquid according to the present invention, it is possible to produce flowage of a coating liquid within a manifold such that the deviation of the average flow rate of the coating liquid in the direction of the width becomes equal to or less than 60% of an average flow rate over the entire area of the manifold, in at least 80% of the area from a liquid supplying portion to an end portion. This can uniformize the coating-liquid flowing time period in the direction of the manifold width, thereby suppressing the occurrence of stripes in the coating liquid applied to the object-to-be-coated.

With the apparatus for coating with a coating liquid according to the present invention, it is possible to form the manifold to have a shape capable of satisfying the equation, which can cause the coating liquid to flow within the manifold for a time period less than the time period during which dispersed particles can be prevented from staying within the manifold as much as possible. This can provide a coating apparatus capable of coating with a coating liquid containing dispersed particles while preventing the occurrence of stripes. Such stripes are considered to be caused by residence of dispersed particles within the manifold.

Further, with the method for designing the coating apparatus according to the present invention, it is possible to design a die capable of causing a coating liquid to flow within a manifold for a time period less than the time period during which dispersed particles can be prevented from staying within the manifold as much as possible. This enables designing a die capable of coating with a coating liquid containing dispersed particles while preventing the occurrence of stripes. Such stripes are considered to be caused by residence of dispersed particles within the manifold.

DETAILED DESCRIPTION OF THE EMBODIMENTS

Figure 1:
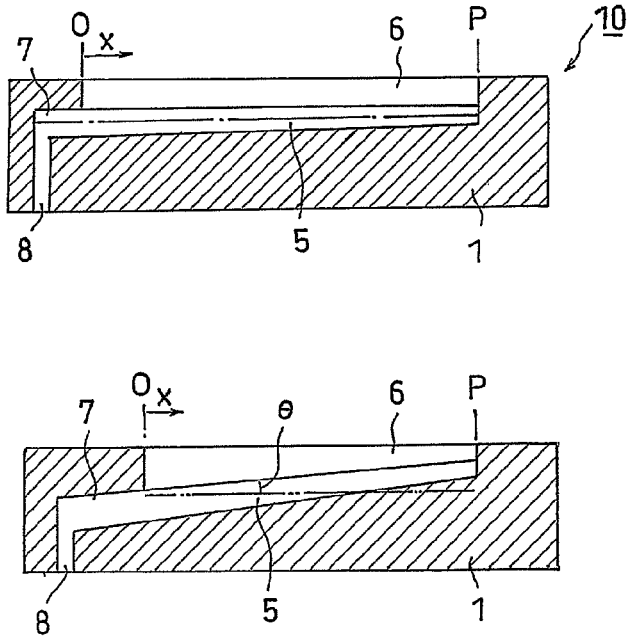
FIG. 1 is a cross-sectional schematic view illustrating a configuration of a die in the direction of the width, according to an embodiment of the present invention.
Figure 2:
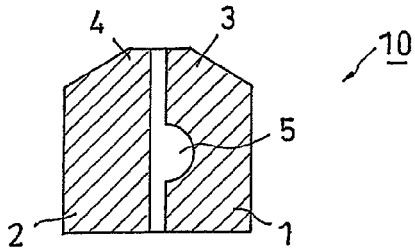
FIG. 2 is a cross-sectional schematic view illustrating the configuration of the die in a direction of a longitudinal cross-sectional area.

At first, there will be described an apparatus for applying a coating liquid according to the present embodiment. FIG. 1 is a cross-sectional schematic view illustrating a configuration of a die in a direction of the width, according to the present embodiment. FIG. 2 is a cross-sectional schematic view illustrating the configuration of the die, in a direction of a longitudinal cross-sectional area.

As illustrated in FIG. 1, the die includes a die main body 10, a manifold 5 formed within the die main body 10, a liquid supplying portion 8 for supplying a coating liquid to the manifold 5, a slot 6, and an upstream-side die lip 3 and a downstream-side die lip 4 provided at the front edge of the die main body 10.

The die main body 10 is a slot die constituted by a combination of an upstream-side die plate 1 and a downstream-side die plate 2, as illustrated in FIG. 2.

The manifold 5 has the function of distributing a coating liquid in the direction of the width of the die. Further, the manifold 5 is provided in the upstream-side die plate 1, such that its cross-sectional shape in the direction of the longitudinal cross-sectional area is a half round shape (see FIG. 2). More specifically, the manifold 5 is shaped in such a way as to satisfy the following equation, assuming that the cross-sectional area thereof in the direction of the longitudinal cross-sectional area is A, and the distance from a position O near the liquid supply portion 8 to an end portion P of the manifold 5 is x.

$$\frac{\partial^2 A}{\partial x^2} \geq 0$$

With the manifold 5 having the shape, the deviation of the average flow rate of the coating liquid in the direction of the width is equal to or less than 60% of the average flow rate in the entire area of the manifold 5, in at least 80% of the entire area from the position O near the liquid supply portion 8 to the end portion P. This can cause the coating liquid to flow within the manifold 5 for a time period less than the time period during which the coating liquid stays within the manifold 5, in at least 80% of the inside area of the manifold 5, thereby alleviating the occurrence of stripes due to the residence of the coating liquid. On the other hand, if the area is less than 80%, this will increase the area in which dispersed particles stay, thereby inducing stripes over the area of the coating film which corresponds thereto. Further, the time period during which the coating liquid stays within the manifold 5 depends on the characteristics of the coating liquid.

Further, in at least 40% of the entire area from the position O near the liquid supplying portion 8 in the manifold 5 to the end portion P, the average flow rate of the coating liquid in the manifold 5 increases with increasing distance from the liquid supplying portion 8. On the other hand, with a conventional die, the average flow rate of the coating liquid decreases with increasing distance from the liquid supplying portion 8.

The manifold 5 is provided within the die main body 10 such that it is parallel to the direction of the width of the die. However, as illustrated in FIG. 1(*b*), the manifold 5 can be provided within the die main body 10, such that it is inclined by an angle θ of 5 degrees or less toward the slot 6, about the liquid supplying portion 8. By forming the manifold 5 at such a position, it is possible to prevent the increase of the variation of the film thickness in the direction of the width of the die.

The liquid supplying portion 8 is provided in the upstream-side die plate 1. Further, the liquid supplying portion 8 is communicated with the manifold 5. The slot 6 is formed between the upstream-side die lip 3 (the upstream-side die plate 1) and the downstream-side die lip 4 (the downstream-side die plate 2), from the manifold 5 to the front edge of the die main body 10. The slot 6 and the manifold 5 are communicated with each other, through an inlet interval 7.

The upstream-side die lip 3 and the downstream-side die lip 4 function as a coating-liquid ejecting port. The lip width is preferably in the range of 0.05 to 10.00 mm and is more preferably in the range of 0.10 to 1.00 mm. However, it is preferable to define the lip shape within the range, properly depending on the viscosity of the coating liquid. For example, if the viscosity is in the range of 0.1 to 5 mPa·s, the lip width is preferably in the range of 0.05 to 0.30 mm. If the viscosity is in the range of 2 to 10 mPa·s, the lip width is preferably in the range of 0.20 to 0.50 mm. If the viscosity is equal to or greater than 8 mPa·s, the lip width is preferably equal to or greater than 0.50 mm. If the viscosity is equal to or greater than 100 mPa·s, it is preferable to add R to the slot-side angle of the downstream-side die lip 4.

The coating liquid for use in the present invention contains slurry or dispersed particles such as Si particles and is a coating liquid which exhibits a change with time, such as aggregation, solidification, gelation and the like, or a coating liquid which exhibits sedimentation of dispersed particles when it is statically placed for a predetermined time period. These coating liquids have shorter lives than those of coating liquids containing no dispersed particles, since such dispersed particles can be uniformly dispersed only during a limited time period.

The viscosity of the coating liquid is preferably in the range of 0.1 to 1000 mPa·s, more preferably in the range of 1 to 500 mPa·s and, more preferably, in the range of 1.5 to 50 mPa·s. If the viscosity is in the range, it is possible to control the variation of the coating thickness by controlling the drying after coating and also it is possible to alleviate the influences of external disturbances, which enables uniform coating. If the viscosity is less than 0.1 mPa·s, the coating film is prone to being influenced by external disturbances after coating, which may cause degradation of the uniformity of the coating film, such as unevenness of drying, after drying. Further, if the viscosity is greater than 1000 mPa·s, the coating film is less prone to being influenced by external disturbances, but it may be difficult to control, after coating, the coating thickness variation induced during the coating. Further, this may degrade the uniformiziation effect of a leveling agent for eliminating side drips and stripes induced during coating.

Further, there is no particular limitation on the shear velocity of the coating liquid, but the shear velocity is preferably in the range of 1000 to 10000/s and is more preferably in the range of 2000 to 10000/s. There is no particular limitation on the density of the coating liquid, but the density is preferably in the range of 0.8 to 1.1 g/cm$^3$ and is more preferably in the range of 0.9 to 1.0 g/cm$^3$.

While the method for coating with the die according to the present embodiment is preferably applicable to a die coater, this method is also applicable to coaters using dies, such as slide coaters, slide curtain coaters, slot die coaters, extrusion coaters.

Also, it is possible to install a vacuum box upstream of the coating film in the die coater and to create a negative pressure within the vacuum box with a blower, in order to take a measure for stabilizing the liquid shape of the coating film.

Next, there will be described a method for designing the coating apparatus. The coating-apparatus designing method according to the present embodiment is conducted, through three-dimensional flowage calculations, by changing the data of the die-inside shape, until the cross-sectional area A of the manifold 5 provided within the die in the direction of the longitudinal cross-sectional area and the distance x from the position O near the liquid supplying portion 8 to the manifold 5 satisfy the following equation.

$$\frac{\partial^2 A}{\partial x^2} \geq 0$$

As data of the material of the coating liquid, the viscosity (mPa·s) and the density (g/cm$^3$) of the coating liquid are employed.

As data of the coating condition, the amount of supplied coating liquid is employed. The amount of supplied coating liquid can be derived from the line speed (m/min), the thickness of the coating film (before drying) and the coating width (mm).

As data of the die-inside shape, for example, the cross-sectional area A of the manifold 5 in the direction of the longitudinal cross-sectional area and the distance x from the position O near the liquid supplying portion 8 to the manifold 5 are employed. Also, as required, data of the liquid supplying portion 8 and the like can be included in the die-inside shape, for calculations.

As the three-dimensional fluid calculations, it is possible to exemplify calculations using, for example, a finite volume method and a finite element method. Further, as the calculator, it is possible to employ various types of calculators which have been conventionally well known.

As described above, with the method for coating with a coating liquid, the coating apparatus for use therein and the method for designing the same, according to the present embodiment, it is possible to prevent the occurrence of stripes in the coating film, which enables continuous coating for a longer time period than micro gravure methods, for example. This also enables increasing the line speed. Accordingly, with the present invention, it is possible to realize, with a slot die method, formation of hard coating layers, optical diffusion layers, anti-glare layers and the like, for example, which is particularly advantageous.

Hereinafter, there will be exemplarily described preferable examples of the present invention, in detail. Unless otherwise restrictively specified, materials, compositions and the like which will be described in these examples will not be intended to restrict the scope of the present invention, but will be merely illustratively described.

(Designing of Coating Apparatuses)

At first, a coating apparatus for use in first to fifth examples was designed. In the designing, the viscosity (mPa·s), the shear velocity and the density of a coating liquid were employed, as data of the material of the coating liquid. Further, the amount of supplied coating liquid was employed, as data of the coating condition. The amount of supplied coating liquid was determined, on the basis of the line speed (m/min), the thickness of a coating film before drying, and the coating width (mm).

On the basis of these respective data, three-dimensional flowage calculations were conducted, using a finite volume method (for example, analysis software "FLUENT Analysis" manufactured by Fluent Corporation), in such a way as to satisfy the following equation, using the cross-sectional area A of the manifold in the direction of the longitudinal cross-sectional area and the distance x from the vicinity of the liquid supplying portion to the manifold end, as data of the die-inside shape.

$$\frac{\partial^2 A}{\partial x^2} \geq 0$$

Figure 3:
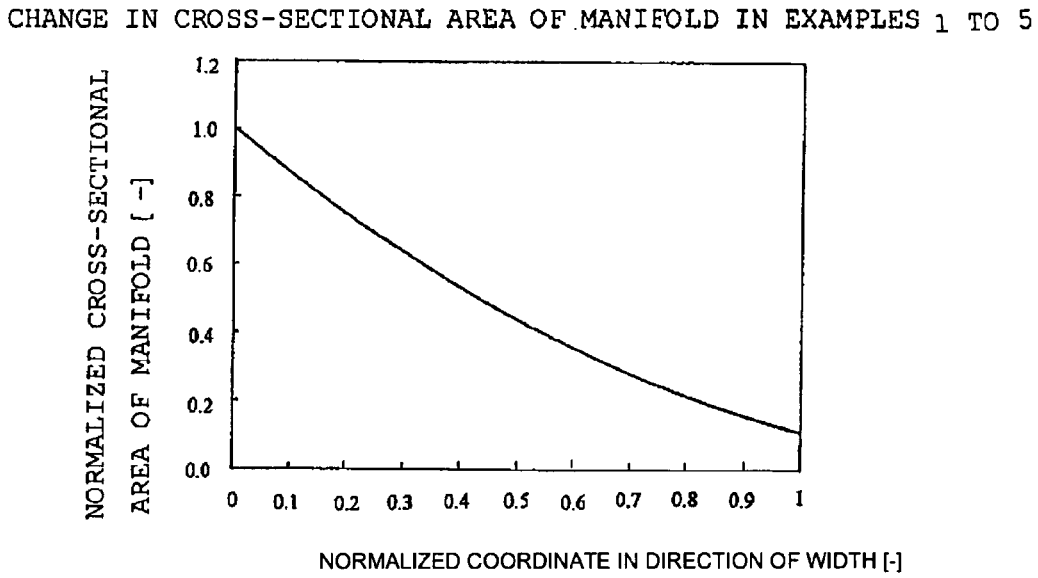
FIG. 3 is a graph illustrating the change of the cross-sectional area of a manifold of a die in a longitudinal direction, according to examples of the present invention, illustrating the relationship between a normalized coordinate in the direction of the die width and the cross-sectional area of the manifold which is normalized with respect to a position O.

Namely, the three-dimensional flowage calculations were conducted, such that the cross-sectional area of the manifold in the direction of the longitudinal cross-sectional area changed along a curve illustrated in FIG. 3. The same figure is a graph illustrating the change of the cross-sectional area of the manifold of the die according to the respective examples, in the longitudinal direction, illustrating the relationship between a normalized coordinate in the direction of the die width and the cross-sectional area of the manifold which was normalized with respect to the position O. Further, the liquid supplying portion in the die for use in the respective examples was positioned at one end of the die (see FIG. 1).

Figure 4:
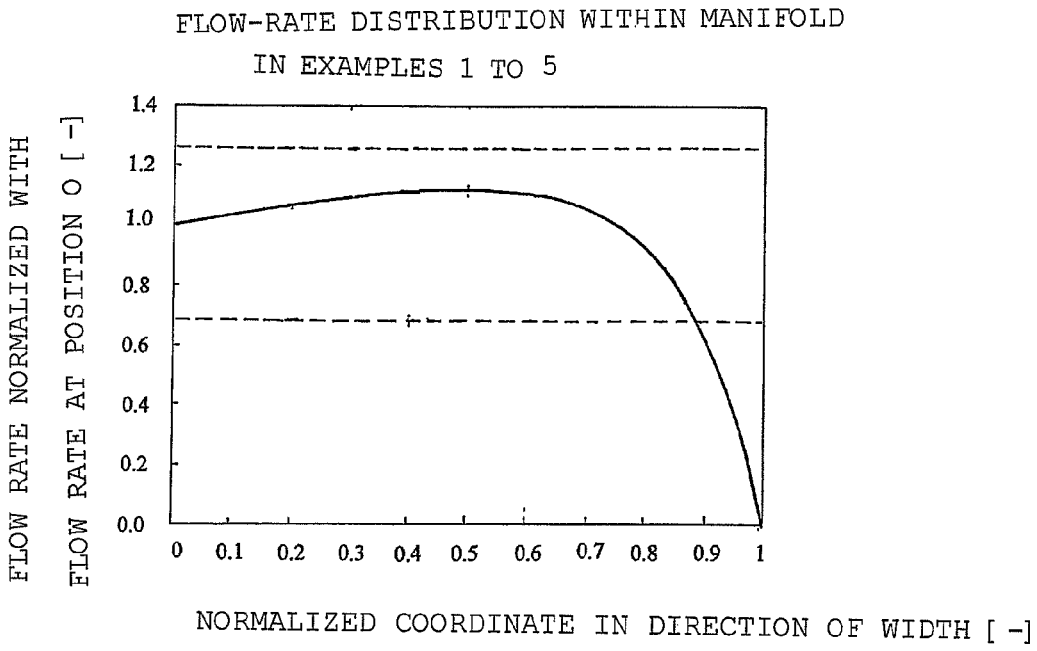
FIG. 4 is a graph illustrating the flow rate distribution within the manifold in the die according to the examples of the present invention, illustrating the relationship between the normalized coordinate in the direction of the die width and the flow rate normalized with the flow rate at the position O (the liquid supplying portion)

Further, the three-dimensional flowage calculations were conducted, such that the flow rate distribution within the manifold was along a curve illustrated in FIG. 4. The same figure is a graph illustrating the flow rate distribution within the manifold in the die according to the examples, illustrating the relationship between the normalized coordinate in the direction of the die width and the flow rate normalized with the flow rate at the position O (the liquid supplying portion). As can be seen from FIG. 4, the area in which the deviation of the average flow rate of the coating liquid in the direction of the manifold width is equal to or less than 60% of the average flow rate of the entire area of the manifold occupied about 90% of the entire area from the position O near the liquid supplying portion in the manifold to the end portion.

Figure 5:
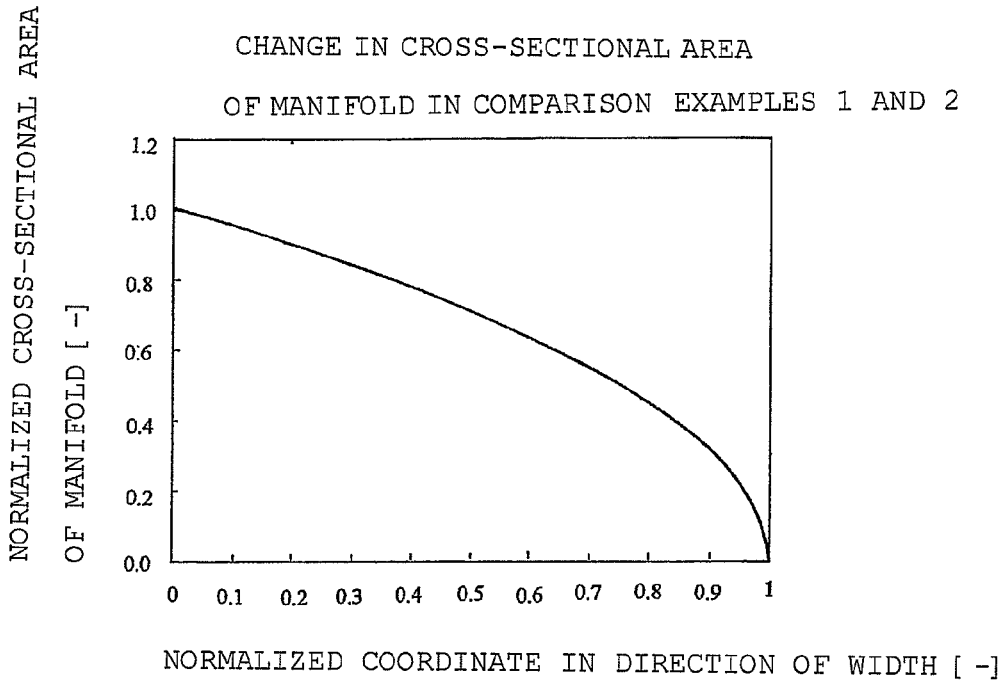
FIG. 5 is a graph illustrating the change of the cross-sectional area of a manifold of a die according to a comparison example in the longitudinal direction, illustrating the relationship between a normalized coordinate in the direction of the die width and the cross-sectional area of the manifold which is normalized with respect to the position O.
Figure 7:
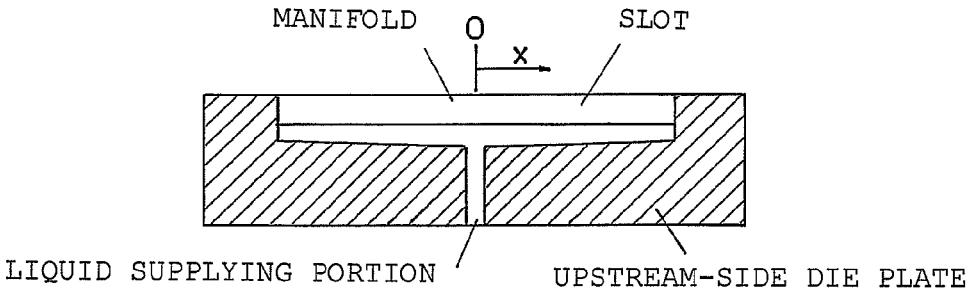
FIG. 7 is a cross-sectional schematic view illustrating the configuration of the die in the direction of the width, according to a comparison example.

Next, coating apparatuses for use in first and second comparison examples were designed. The designing was conducted on the basis of C. I. Chung's theory (C. I. Chung and D. T. Lohkamp, Modern Plastics, March 1976, p.p. 52-55), which utilizes an exponential law. The characteristics of the material of the coating liquid and the coating condition were the same as those described above. With this, the designing was conducted such that the cross-sectional area of the manifold in the direction of the longitudinal cross-sectional area changed along a curve illustrated in FIG. 5. The same figure is a graph illustrating the change of the cross-sectional area of the manifold of the die according to each of the comparison examples in the longitudinal direction, illustrating the relationship between a normalized coordinate in the direction of the die width and the cross-sectional area of the manifold which was normalized with respect to the position O. Further, the die used in the first comparison example had basically the same constitution as that of the die used in the examples. However, the shape of the manifold was designed on the basis of C. I. Chung's theory and, therefore, the die was different in this regard. Accordingly, the liquid supplying portion and the like were provided at one end of the die, similarly to in the die according to the examples. Further, the liquid supplying portion of the die for use in the second comparison example was provided at the center portion in the direction of the die width (see FIG. 7). Accordingly, the curve illustrated in FIG. 5 illustrates a case where the distance from the position O near the liquid supplying portion to the end portion was normalized, with respect to the die used in the first comparison example (see FIG. 1), while it illustrates a case where the distance from the position O' at the center portion illustrated in FIG. 7 to end portion was normalized, with respect to the die used in the second comparison example.

Figure 6:
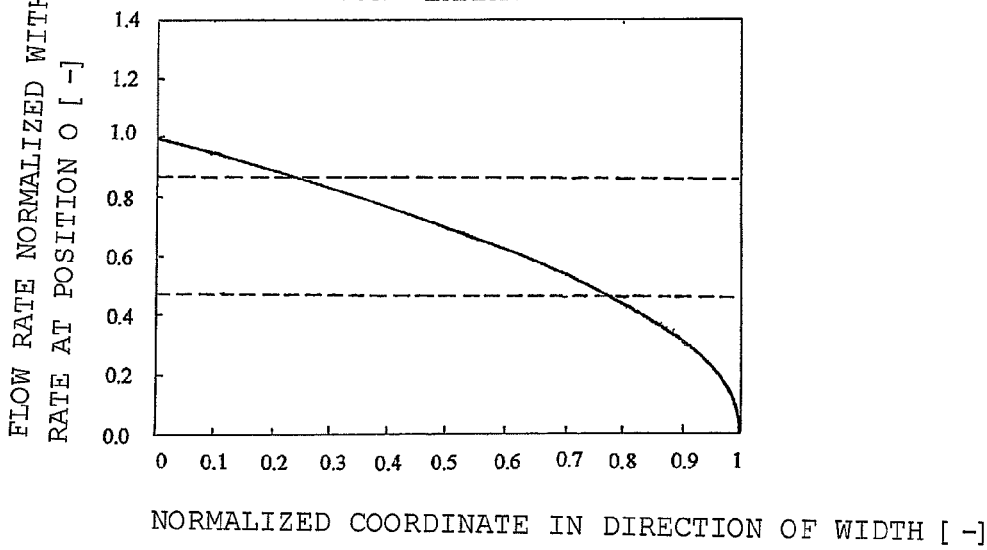
FIG. 6 is a graph illustrating the flow rate distribution within the manifold in the die, illustrating the relationship between the normalized coordinate in the direction of the die width and the flow rate normalized with the flow rate at the position O (the liquid supplying portion)

Further, the flow-rate distribution within the manifold of the die was analyzed by conducting three-dimensional flowage calculations using a finite volume method (FLUENT analysis), for the dies designed on the basis of C. I. Chung's theory. FIG. 6 illustrates a curve representing the results. As can be seen from FIG. 6, the area in which the deviation of the average flow rate of the coating liquid in the direction of the manifold width is equal to or less than 60% of the average flow rate of the entire area of the manifold occupies about 60% of the entire area from the vicinity of the liquid supplying portion in the manifold to the end portion.

(Fabrication of Coating Apparatuses)

On the basis of the results of the calculations, the coating apparatuses for use in the first to fifth examples and the first and second comparison examples were fabricated.

Namely, the die in the coating apparatus for use in the examples was formed, such that the radius of the cross-sectional area of the manifold in the direction of the longitudinal cross-sectional area was 6 mm near the liquid supplying portion and also was 2 mm near the end portion. Further, the radius of the cross-sectional area was varied in proportion to the distance from the liquid supplying portion to the end portion. The portion for coupling the slot and the manifold to each other, namely the inlet interval, was formed to have a straight shape and to be parallel to the tip ends of the die lips. Further, the distance from the coupling portion to the tip ends of the die lips was set to 25 mm. Further, the height of the slot, namely the distance between the upstream-side die lip and the downstream-side die lip, was set to 125 micrometers. The length of the slot in the direction of the width was set to 1000 mm.

The die of the coating apparatus used in the first comparison example had basically the same configuration as the die used in the examples, in terms of placement and the like of respective components. The radius of the cross-sectional area of the manifold in the direction of the longitudinal cross-sectional area was 10 mm near the liquid supplying portion and also was 3 mm near the end portion. Further, the radius of the cross-sectional area was continuously gradually reduced with decreasing distance from the end portion, according to FIG. 5. Further, the distance from the coupling portion to the tip ends of the die lips was set to 25 mm. Further, the height of the slot in the slot die, namely the distance between the upstream-side die lip and the downstream-side die lip, was set to 125 micrometers.

Figure 8:
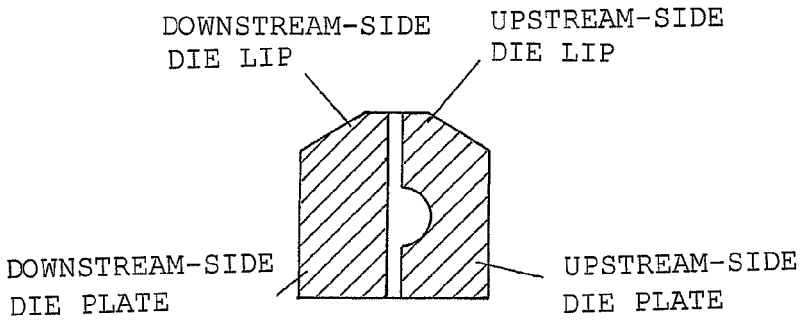
FIG. 8 is a cross-sectional view illustrating the configuration of the die in the direction of the longitudinal cross-sectional area.

Namely, the dies in the coating apparatus used in the second comparison example was formed such that the radius of the cross-sectional area of the manifold in the direction of the longitudinal cross-sectional area was 8 mm near the liquid supplying portion and also was 2 mm near the end portion (see FIG. 8). Further, the radius of the cross-sectional area was continuously gradually reduced with decreasing distance from the opposite ends, according to FIG. 5. The height of the slot was set to 125 micrometers.

FIRST EXAMPLE

As the coating liquid, a coating liquid having a solid concentration of 30 weight % was employed, wherein the employed coating liquid was formed by dissolving an urethane acrylate resin in toluene and further mixing, thereinto, polystyrene particles (with an average grain size of 3 micrometers), on the basis of the data of the material of the coating liquid. This coating liquid was supplied to the die and was applied to a PET (Polyethylene terephthalate) film (with a thickness of 75 micrometers) at a line speed of 10 m/min. The coating film had a thickness of 5 micrometers after drying, and the coating width was 1000 mm. Further, the coating liquid had a viscosity of 5 mPa (in conformity with JIS K 7117-1) and had a density of 0.95 g/cm$^3$.

SECOND EXAMPLE

The coating liquid was applied to a PET film, in the same way as in the first example, except that the line speed was set to 15 m/min.

THIRD EXAMPLE

The coating liquid was applied to a PET film, in the same way as in the first example, except that the slot height was set to 50 micrometers.

FOURTH EXAMPLE

The coating liquid was applied to a PET film, in the same way as in the third example, except that the line speed was set to 15 m/min.

FIFTH EXAMPLE

The coating liquid was applied to a PET film, in the same way as in the third example, except that the coating film was formed to have a thickness of 2 micrometers after drying.

FIRST COMPARISON EXAMPLE

The coating liquid was applied to a PET film, in the same way as in the first example, except that the used coating apparatus included a die designed on the basis of C. I. Chung's theory.

SECOND COMPARISON EXAMPLE

The coating liquid was applied to a PET film, in the same way as in the first comparison example, except that the liquid supplying portion was placed at the center portion of the manifold in the direction of the width, in the used coating apparatus.

(Results)

Visual evaluations were conducted on the coating films formed on the PET films, in the first to fifth examples and the first and second comparison examples. The visual evaluations were conducted by visually inspecting them for stripes and checking the areas in which such strips had occurred. The results are illustrated in the following table 1.

TABLE 1

| | Presence or absence of stripes | Area in which stripes are generated |
|---|---|---|
| Example 1 | Absence | — |
| Example 2 | Absence | — |
| Example 3 | Absence | — |
| Example 4 | Absence | — |
| Example 5 | Absence | — |
| Comparison Example 1 | Presence | Entire area of the coating width |
| Comparison Example 2 | Presence | At 500 mm from the opposite coating ends |

What is claimed is:

1. An apparatus for coating an object-to-be-coated with a coating liquid containing dispersed particles, using a die, wherein said die comprises:

a die main body constituted by a pair of die plates;

a manifold formed within said die main body for distributing the coating liquid in a direction of width, wherein the distribution of the coating liquid is terminated at an end portion of the manifold;

a liquid supplying portion provided in at least any one of said pair of die plates for supplying the coating liquid to said manifold;

a slot formed between the pair of die plates so as to extend from said manifold to a front edge of the die main body; and a die lip provided at the front edge of said die main body as a coating-liquid ejecting port, and said manifold is provided within the die main body, either in parallel to the direction of the width of said die or to be inclined toward said slot by an angle not more than 5 degrees about said liquid supplying portion, and said manifold is shaped such that the following equation is satisfied, assuming that a cross-sectional area of said manifold in a direction of a longitudinal cross-sectional area is A, and a distance from a predetermined position near said liquid supplying portion to the end portion of the manifold is x, $$\frac{\partial^2 A}{\partial x^2} \geq 0.$$

2. The apparatus for coating with a coating liquid according to claim 1, wherein said manifold is shaped such that deviation of an average flow rate of said coating liquid in a direction of width becomes equal to or less than 60% of an average flow rate over an entire area of the manifold, in at least 80% of an area from a liquid supplying portion in said manifold to an end of said manifold.

3. The apparatus for coating with a coating liquid according to claim 2, wherein said manifold is shaped such that the average flow rate of said coating liquid is increased with increasing distance from the liquid supplying portion, in at least 40% of the area from the liquid supplying portion in said manifold to the end portion of said manifold.

4. The apparatus for coating with a coating liquid according to claim 3, wherein said liquid supplying portion is provided near at least one of the end portions of said die in the direction of the width of said die.

* * * * *